United States Patent [19]

Puchegger

[11] Patent Number: 4,686,899

[45] Date of Patent: Aug. 18, 1987

[54] SHUTTLE MOUNTING IN MATRIX LINE PRINTER

[75] Inventor: Karl Puchegger, Foehrenau, Austria

[73] Assignee: Mannesmann Tally GmbH, Vienna, Austria

[21] Appl. No.: 913,080

[22] Filed: Sep. 29, 1986

[30] Foreign Application Priority Data

Sep. 28, 1985 [EP] European Pat. Off. ..... 85112334.9

[51] Int. Cl.[4] ..... B41J 3/04

[52] U.S. Cl. ..... 101/93.04; 400/121; 400/124

[58] Field of Search ..... 101/73.15, 93.04–93.05; 400/121, 124

[56] References Cited

U.S. PATENT DOCUMENTS 3,837,460 9/1974 Chida et al. ..... 400/124
4,218,149 8/1980 Okada ..... 400/124
4,446,789 5/1984 Matsumoto et al. ..... 101/93.04

FOREIGN PATENT DOCUMENTS 0175009 3/1986 European Pat. Off. ..... 101/93.04

*Primary Examiner*—Edgar S. Burr
*Assistant Examiner*—Joseph McCarthy
*Attorney, Agent, or Firm*—Ralf H. Siegemund

[57] ABSTRACT

A matrix line printer which includes a shuttle-carrier mounted in a frame for limited reciprocating movement and supporting a plurality of print elements; a plurality of rollers are journalled in the frame and arranged parallel to the direction of reciprocating movement of the shuttle, projections on the shuttle engage the rollers; a pair of circularly round, cylindrical guide pins are arranged in coaxial relation to each other and mounted to respective opposite ends of the shuttle, run in a pair of corresponding sleeve-like bearings; leaf springs on the shuttle urge the projection against the rollers; and additional springs are arranged transversely to the coaxial alignment of said pins for balancing purposes.

5 Claims, 3 Drawing Figures

SHUTTLE MOUNTING IN MATRIX LINE PRINTER

BACKGROUND OF THE INVENTION

The present invention relates to a matrix printer particularly a matrix line printer wherein a back and forth or reciprocating member such as a shuttle carrying the print elements is of light-weight construction.

Matrix printers of the type to which the invention pertains usually include drive elements for the dot printing elements and being mounted on the shuttle. These drive elements usually are of electromagnetic design. The print elements are operated by a logic curcuit and a power drive circuit and cables connect them to that energizing and control circuit of the printer. These cables are constructed for example, as flexible strips or ribbon cable.

The logic circuit, broadly understood, includes or is connected to a symbol generator so as to obtain the proper combination dot printing action. In addition, the shuttle is, for example, guided by means of rollers which are suitably journalled in the frame of the printer and extend in parallel to the direction of shuttle motion. The European Pat. No. 8,411,106, which has been published subsequent to the date of priority of the present application, (see also U.S. application Ser. No. 777,538 filed Sept. 18, 1985 by me and another inventor) is descriptive of this kind of matrix printer but does not constitute a state of the art. However, the present application is to be seen as an improvement and further extension of the matrix printer as per said European patent application.

Printers of the type to which the invention pertains include, for example, solenoid drives for the print elements, the latter being for example, needles or styli. The print element carrier or shuttle can in fact be considered an oscillating device, the oscillations to occur along the print medium. Following the printing of a line of dots, the print medium is moved transversely to both the direction of styli movement as well as the direction of shuttle movement, by a very small spacing that is equivalent to a vertical dot distance.

The print element carrier and shuttle is of lightweight construction as stated and the individual print elements should also have a low mass. The needle bank (needles plus solenoid drives), so to speak and as carried by (or being part of) the shuttle, consumes a certain amount of electric power. That power is of course not completely converted into "printing power", but certain losses occur. These losses actually heat the print elements, and the thermal energy will flow primarily into the metallic shuttle. During extensive use and long time of printing, the shuttle will become quite warm, and, therefore, must be expected to expand physically. Consequently, the shuttle will undergo a certain physical expansion in accordance with certain basic laws of physics. This expansion however may entail for one reason or another and having to do with the mounting and the overall construction, a certain deformation of the shuttle. Owing to the minuteness of the various spacings involved, even a relatively small relative thermal expansion between or among the print elements cannot be tolerated, if specifically the spacing of the dots as printed varies on account of these thermal activities. These changes are usually not immediately noticeable but, say, after several hours of printing it has been observed that the appearance of the printing varies and usually deteriorates. To the best of my knowledge, no known features exist to prevent this kind of distortion and to adequately protect the shuttle i.e. the print element carrier against these thermally induced distortions.

DESCRIPTION OF THE INVENTION

It is an object of the present invention to provide a new and improved matrix printer, particularly a matrix line printer, having a shuttle on which the print elements are mounted, and to provide for a support and mounting structure for the shuttle so that indeed thermal expansions, and particularly tensions are avoided so that the shuttle will not or at least to a lesser extend undergo distortions such as bending or warping which would become noticeable in a vertical relocation of the dots as they are being printed by the print elements carried by the shuttle.

In accordance with the preferred embodiment of the present invention, the object is obtained in that the shuttle is mounted and guided longitudinally by means of two coaxially arranged cylindrical guide pins respectively mounted to the ends of a first (lower) part shuttle; these pins thus movably mount the shuttle in longitudinally effective bearings for motion in longitudinal (shuttle movement) direction; the shuttle as a whole is spring biased so that certain guide projections on the second (upper part) bear continuously against the rollers which are mounted in the frame; additional compression springs act transversely to the longitudinal guiding of the shuttle for resiliently supporting and mounting the two shuttle parts in relation to each other. Thus, the reciprocating shuttle and print element carrier is in fact supported in a floating fashion, i.e. the construction is such that the thermal tension owing to heat development, will, in fact, be taken up whereby any dislocation of the carrier is no longer effective in the print pattern as provided by the print elements as carried by this element carrier-shuttle. In spite of this floating type of mounting, the accuracy of positioning of the carrier, and therefore of the print elements, does not deteriorate the appearance of the print pattern, and is, in fact, assured through the resiliency of various springs involved obtaining guidance into transversely disposed planes.

In furtherance of the invention, it is suggested to mount the rollers in the frame to thereby establish a vertical plane of guiding and reference and the shuttle carrier is held against the rollers by means of biased leaf springs. Owing to the bias these leaf springs exert a torque on the shuttle which causes the carrier to be urged against the guide rollers. Such leaf springs are particularly suitable on account of their flat extension because in addition to the regular force they have another degree of freedom for acting independent from the longitudinal motion of the carrier. Preferably, the leaf springs are supported in that several glide elements are distributed in the frame over the length of guidance. The leaf springs therefore bear against well defined locations on the side elements whereby the bias of the springs remains constant. In furtherance of the invention is suggested to provide the glide elements as bodies with an oblique surface for obtaining the bias. The friction between the glide element and the leaf spring can be lowered by making the glide element from a self-lubricating synthetic.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
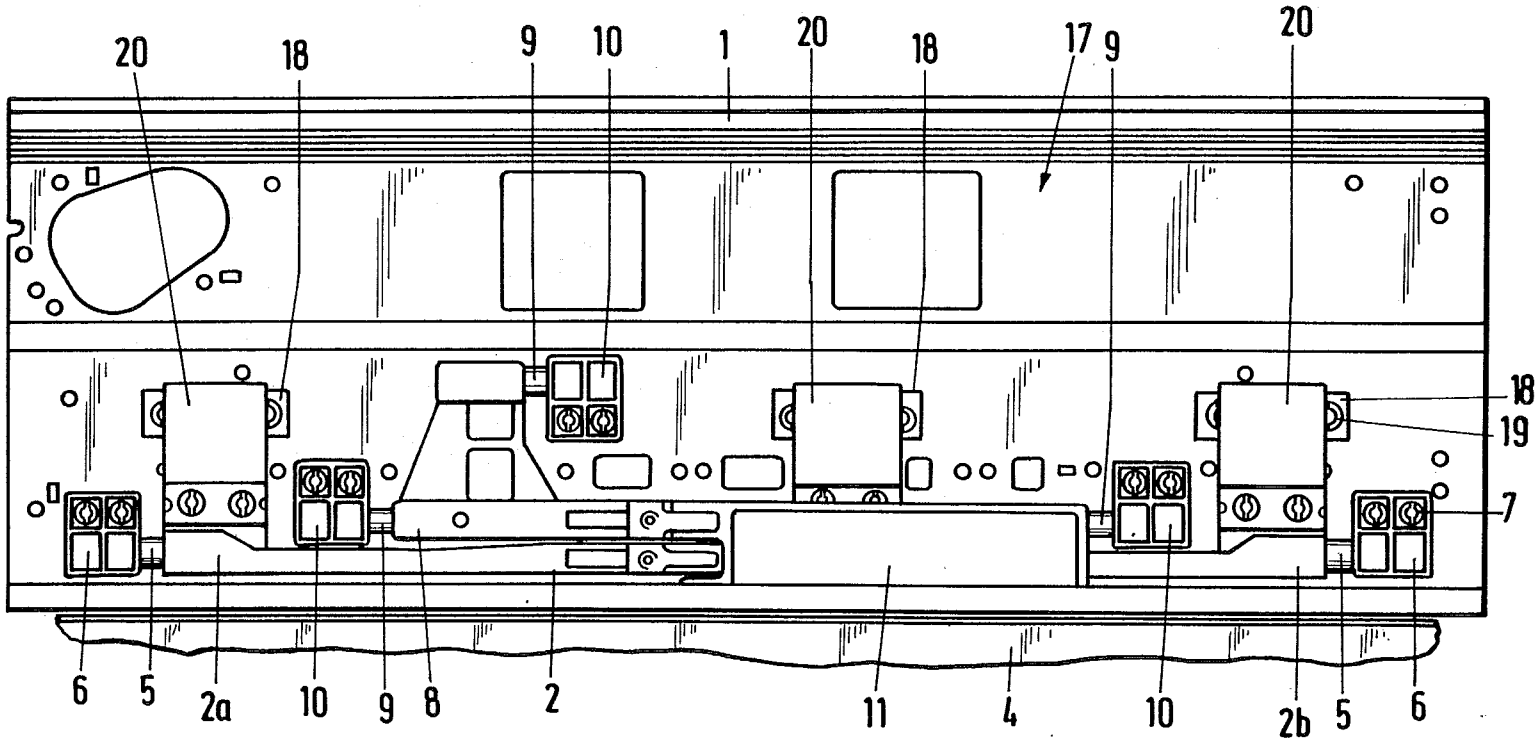
FIG. 1 is a bottom view, from below, of a print frame pertaining to a matrix line printer and showing also many parts thereof.

The matrix line printer includes a frame 1 on which a print element carrier or shuttle 2 undergoes reciprocating or oscillatory motion. A frame platform 1*a* divides the space into an upper (12) and a lower (17) mounting space, and mounting bars 1*b* and 1*c* extend in downward direction.

The carrier or shuttle 2 is of two part construction, there is an upper part 2*d* and a lower part 2*e;* both of them are of a light-weight construction. The upper part 2*d* carries a plurality of print elements 3. These elements 3 each are comprised of a solenoid type electromagnet and they are arranged along a horizontal line on the shuttle 2. For example, and in a typical case, the shuttle carries thirty-three such solenoids each provided for driving a print needle or stylus. Together they establish a needle bank. The print needles and the respective cases or housings of the solenoids extend parallel to each other and they extend also exactly in a horizontal direction, and in a common horizontal plane. Any adjustment of the print process is carried out vis-a-vis the stationary frame which includes a thrust mount 4; this is so because ultimately the print medium is positioned in relation to the frame. In addition, a compensating or balancing mass is provided which extends parallel to but moves opposite to the carrier 2. The dynamics of the mass-shuttle relation is significant for the stability of shuttle movement but insufficient to avoid warping of the shuttle.

Electric cables (not shown) feed electric current, i.e. driving power, to the solenoids, whereby it has to be observed that owing to high speed requirements generally and/or particularly a high retracting speed of the needles, and owing further to the speed of the print process the oscillation forces acting on the print needles are quite large, in spite of a relatively low mass, of the parts being moved so that the electric current consumption is rather significant. Consequently, a considerable portion of the electric power which is fed to the hammer bank generally and to the solenoid assembly in particular is converted into heat. After several hours of more or less continuous printing the operating temperature of the shuttle and of the surrounding parts, including the parts carried by the shuttle, will gradually rise.

The temperature increase of the shuttle 2 may interfere with printing operation for the following reasons. Generally, the shuttle is made, for example, of a light metal but regardless of its configuration, such a shuttle becomes distorted upon increase in temperature, so that, as was mentioned already in the introduction, the appearance of the print will deteriorate, unless steps are taken to prevent that.

The shuttle is made of an upper part 2*d* of L-shaped cross section, and of a lower part 2*e*. As a whole the carrier 2 is guided in several planes and in relation to several directions. First of all, carrier ends 2*a* and 2*b* extend respectively from lower part 2*e* and carry guide pins 5*a* and 5*b* which run in and are guided by longitudinal bearings 6*a* and 6*b* respectively. The longitudinal bearings 6*a* and 6*b* are fasten to the frame 1 by means of screws or bolts 7. The balancing body 8 is also provided with guide pins 9 which, in turn, are guided in longitudinal bearings and mounts 10, quite similar to mounts 6*a, b*. A longitudinal section piece 11, visible only in FIG. 1, covers parts of the carrier or shuttle 2; only the lower portion 2*e* of shuttle 2, underneath frame 1, is visible in FIG. 1.

Figure 2:
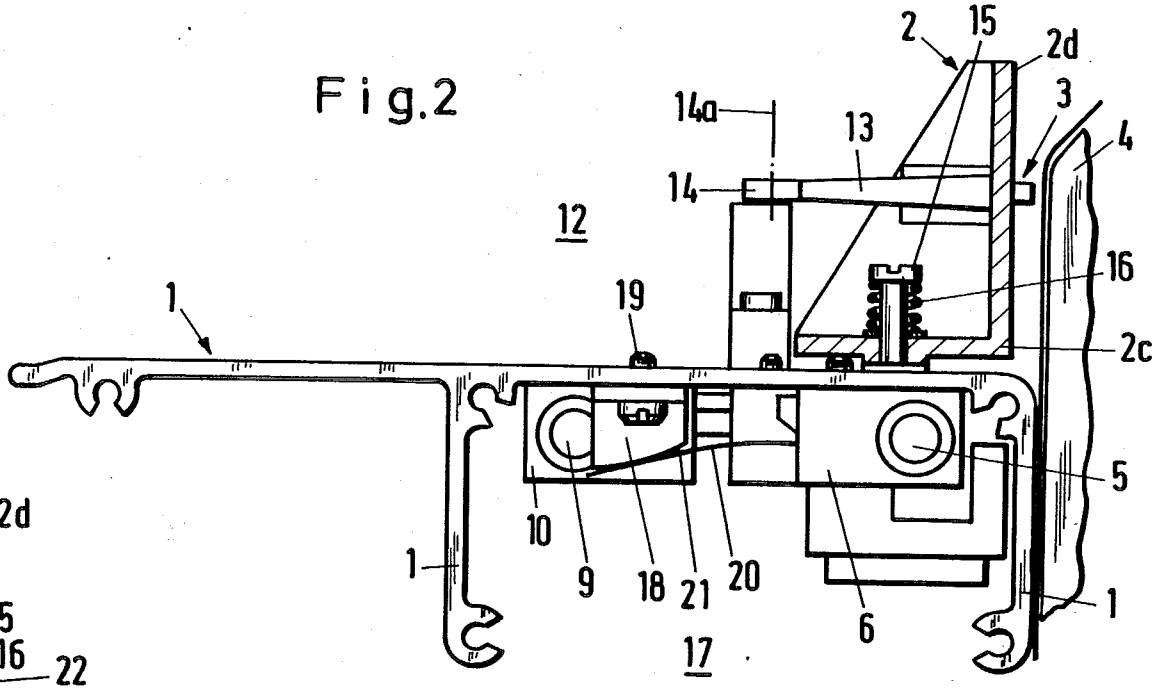
FIG. 2 is a side view of the same printer shown in FIG. 1, the view direction being towards the side of the frame, and showing additionally the shuttle and carrier for print elements.
Figure 3:
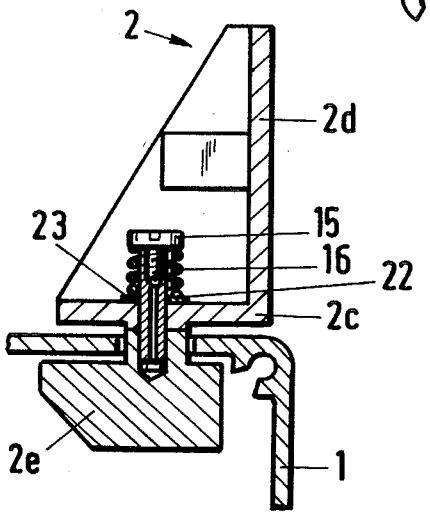
FIG. 3 is a cross section through the fastening structure of the shuttle.

The upper part 2*d* of the shuttle 2 is situated above the print frame 1, and on the upper side 12, an upright wall of the upper shuttle part 2*d* carries the print elements 3. Additionally, guiding projections 13 extend rearwardly from upper shuttle part 2*d* and in horizontal direction. The projections 13, in turn, bear against rollers 14 mounted for journalling in the frame 1, also on the upper side 12. These projections 13 bear against rollers 14 along the direction of shuttle movement. Moreover, the arms 13 are spaced over the length extension of shuttle or carrier 2. All of the rollers 14 have fixed vertical axes 14*a* and together these axes establish a common vertical plane. Owing to the fact that the rollers 14, individually engaging the arms 13 have similar diameter, the points of engagement establish a common vertical guide plane 14*b*. Maintaining the arms 13 in engagement with rollers 14 and, therefore, the shuttle in relation to that reference plane 14*b* is carried out as follows:

The carrier 2 is held and supported in a floating fashion, as can be seen in FIGS. 2 and 3. Slide or guide elements 18 are fastened on the underside of frame part 1*b* as shown in FIG. 2 and by means of bolts 19. Leaf springs 20 bear against these elements 18. These leaf springs 20 are distributed in spaced-apart relationship on the carrier part 2*e* and are fastened thereto. The length 1 of the leaf spring 20 in the direction of shuttle movement is chosen to match the back and forth movement and amplitude of the shuttle 2 so that the springs 20 remain in engagement with stationary elements 18. The length 1 is approximately just two to three times the width of a character of that kind that is to be printed. In order to obtain a bias of the springs 20, the glide support and biasing elements 18 are provided with oblique surfaces, 21. This feature is effective all along the extension of the shuttle.

Owing to the springs 20, a torque is exerted on the shuttle 2 for uniformly urging it to remain in particular position in relation to the reference plane 14*b*. Next, the carrier-shuttle 2*d* and 2*e* are resiliently supported in relation to each other by means of compression springs 16 extending respectively between the heads of bolts 15 and the bottom 2*c* of shuttle part 2*d*. The shuttle 2 is prevented from being lifted out of this position because parts 2*d* and 2*e* extend on opposite sides of frame part 1*a*. This mode of fastening however still permits a limited pivot motion of and a corresponding to the degree of freedom for the carrier 2.

The shuttle bottom 2*c* is traversed by a centering sleeve 22 which is firmly pressed into the lower carrier part 2*e* on the underside 17. Each spring 16 is situated in the upper part 12 surrounds the respective centering sleeve 22. The spring 16 is actually tensioned between a pressure disk 23 and the head of the respective bolt 15. The outer diameter of the centering sleeve 22 is chosen so that the sleeve can more or less slide freely but without play in the bottom part 2*c* of the carrier-shuttle 2. Thus, the shuttle as a whole is resiliently supported for engagementwith rollers 14, and the element (3) carrying part 2*d* is resiliently supported on lower part 2*e* which is guided by cylindrical pins (5*a, b*) in stationary bearings. The resilient and, thus, floating mode of affixation of the carrier 2 is actually duplicated several times as far as a length extension of the carrier is concerned by multiple springs 20 and multiple springs 16. It can thus be seen, that the shuttle and here particularly the print element carring part 2*d* will not warp or be distorted on account of the floating suspension. Any thermal expansion affects these parts as a whole and, therefor, will not disturb the linear horizontal alignment of the print elements, nor render their spacing nonuniform in the direction of printing.

The invention is not limited to the embodiments described above, but all changes and modifications thereof, not constituting departures from the spirit and scope of the invention are intended to be included.

I claim:

1. In a matrix line printer which includes a frame, a shutter-carrier mounted in the frame for limited reciprocating movement and provided for supporting a plurality of print elements, a plurality of rollers journalled in the frame and arranged along a line parallel to the direction of reciprocating movement of the shuttle; the improvement comprising:

said shuttle having vertically arranged first and second separate shuttle parts secured together, a plurality of projecting arms on the second shuttle part each of said arms engaging one of said rollers and being guided thereby, a pair of guide pins arranged in coaxial relation to each other and being mounted to respective opposite ends of said first shuttle part, said pins having a circular cross section and a cylindrical overall configuration;

a pair of corresponing sleeve-like bearings mounted to the frame and receiving respectively said pins;

first spring means on the shuttle for urging said projections against said rollers; and compression springs arranged to exert a force transversely to the coaxial alignment of said pins, said compression springs being in mounted to resiliently hold said first and second shuttle parts in contact with each other.

2. In a printer, the improvement as in claim 1 wherein said rollers together define and establish a vertical plane of guiding.

3. In a printer as in claim 2 said first spring means being leaf springs affixed to said shuttle, a slide element associated with each of said leaf springs, each slide elements being mounted to said frame, said leaf springs bearing resiliently against said slide elements and exerting a torque upon said shuttle to maintain the shuttle arms in engagement with said rollers.

4. In a printer as in claim 3 said slide elements each having an oblique surface to provide a deflecting bias for each respective leaf spring.

5. In a printer as in claim 3 said slide elements being made of a self-lubricating synthetic material.

* * * * *